United States Patent [19]

Dakin et al.

[11] 4,119,390

[45] Oct. 10, 1978

[54] LIQUID-COOLED, TURBINE BUCKET WITH ENHANCED HEAT TRANSFER PERFORMANCE

[75] Inventors: James T. Dakin, Schenectady; Kenneth A. Darrow, Sprakers, both of N.Y.

[73] Assignee: General Electric Company, Schenectady, N.Y.

[21] Appl. No.: 743,271

[22] Filed: Nov. 19, 1976

[51] Int. Cl.[2] ..... F01D 5/18

[52] U.S. Cl. ..... 416/96 R; 416/97 R

[58] Field of Search ..... 416/97, 96, 92, 96 A; 165/184, 179

[56] References Cited

U.S. PATENT DOCUMENTS

| | | | |
|---|---|---|---|
| 206,998 | 8/1878 | Baker | 165/184 |
| 2,068,955 | 1/1937 | Kritzer et al. | 165/179 |
| 2,079,144 | 5/1937 | Appa | 165/179 |
| 2,120,764 | 6/1938 | Newton | 165/179 |
| 2,691,281 | 10/1954 | Phillips | 165/179 |
| 2,843,354 | 7/1958 | Smith | 416/92 |
| 2,864,405 | 12/1958 | Young | 416/96 A X |
| 3,156,544 | 11/1964 | Eck et al. | 165/184 |
| 3,619,076 | 11/1971 | Kydd | 416/92 |
| 3,804,551 | 4/1974 | Moore | 416/97 |
| 3,936,227 | 2/1976 | Wojcik | 416/97 R X |

FOREIGN PATENT DOCUMENTS

| | | | |
|---|---|---|---|
| 594,931 | 3/1934 | Fed. Rep. of Germany | 416/92 |
| 2,430,584 | 1/1976 | Fed. Rep. of Germany | 165/179 |
| 651,830 | 4/1951 | United Kingdom | 416/96 A |
| 728,834 | 4/1955 | United Kingdom | 416/96 A |
| 457,868 | 1/1975 | U.S.S.R. | 165/184 |

OTHER PUBLICATIONS

R.I. Hodge et al., "A Review of Blade Cooling Systems", part 2, The Gas Turbine, Feb. 1958, pp. 396–398.

*Primary Examiner*—Everette A. Powell, Jr.
*Attorney, Agent, or Firm*—Leo I. MaLossi; Joseph T. Cohen; Charles T. Watts

[57] ABSTRACT

Individual coolant passages in the airfoil portion of a liquid-cooled turbine bucket are provided with means whereby the main flow of liquid coolant moving in each such individual passage during turbine operation under the influence of centrifugal force is split into a pair of flows with each sub-flow moving along a generally helical path. Also, the splitting means is provided with means to interrupt each sub-flow so as to enlarge significantly the internal wall area of such coolant passage with which the liquid coolant makes contact. In the embodiment described the splitting means is a twisted tape member bonded along its edges within a tubular coolant passage and the interrupting means are a series of inwardly-directed slots in the edges of the tape.

6 Claims, 3 Drawing Figures

LIQUID-COOLED, TURBINE BUCKET WITH ENHANCED HEAT TRANSFER PERFORMANCE

BACKGROUND OF THE INVENTION

General teachings for the open-circuit liquid cooling of gas turbine vanes are set forth in U.S. Pat. No. 3,446,481 Kydd; U.S. Pat. No. 3,619,076 Kydd; U.S. Pat. No. 3,658,439 Kydd; U.S. Pat. No. 3,816,022 Day; and U.S. Pat. No. 3,856,433 Grondahl et al., for example. In these patents, the cooling of the vanes, or buckets, is accomplished by means of a large number of spanwise-extending subsurface cooling passages.

The invention described and claimed herein is applicable in those constructions of liquid cooled buckets wherein the coolant passages are cylindrical in configuration. Thus, for example, preformed tubes employed as coolant passages may form a setting for the use of the instant invention. However, the concept of employing preformed tubes as subsurface coolant passages in turbine buckets, per se, as well as particular arrangements for incorporating such tubes in the bucket construction are the invention of other(s) as, for example, is set forth in U.S. patent application Ser. No. 749,719, filed Dec. 13, 1976, and assigned to the assignee of the instant invention.

Tests made on open-circuit water cooled buckets have established that under preferred conditions of operation (e.g., rate of water input, rotating speed, temperature of motive fluid, etc.) the water travels in a thin film through each passage, the axis of the passage being oriented approximately perpendicular to the turbine axis of rotation. The water film is pulled through the channel by centrifugal force, achieving high radial velocity. At the same time, the film experiences a strong Coriolis force, which, as operational rates of cooling water supply, pushes the film into a limited longitudinally-extending area of the coolant passage.

When this occurs, the liquid film covers but a small fraction of the surface area of the coolant passage and the cooling capacity of the liquid flow is reduced. For a given heat flow into each coolant passages or channel, this limited cooling area results in a higher coolant channel surface temperature and this in turn results in a higher bucket skin temperature and shortened bucket life. It would be most desirable to increase the effective cooling area within each coolant passage at any given rate of liquid coolant flow whereby the bucket skin temperature can be reduced and the cyclic fatigue life extended.

The invention described and claimed in U.S. patent application Ser. No. 743,272 — Kydd, filed Nov. 19, 1976, (now abandoned) assigned to the assignee of the instant invention is directed to this same problem. In the Kydd application means (e.g., raised or recessed helical configurations) are provided within individual coolant passages for providing a swirling motion to the liquid coolant. In this manner the liquid coolant is subjected during operation to a first centrifugal force acting in the radial direction, the Coriolis force and a secoond centrifugal force acting about an axis extending in the general direction taken by the coolant passage.

Various vortex flow promoters in stationary systems have been described in an article by A. E. Bergles in *Progress in Heat and Mass Transfer,* volume I, Edited by V. Grigull and E. Hahne [Pergamon Press, 1969]. In stationary systems the cooling fluid is forced through a channel by a pressure drop and the vortex promotion is accomplished at the expense of increased pump power. No discussion or guidance is provided therein of any solution to the problem of increasing the effective cooling area within coolant passages in a rotating system.

DESCRIPTION OF THE INVENTION

Cylindricaly-shaped coolant passages for liquid-cooled turbine buckets are converted according to this invention into at least two helical sub-passageways by flow splitting means introduced into individual coolant passages and fixed in place as by brazing or tight mechanical fit. In addition each flow splitting, or flow modifying, means is provided with means disposed therealong for interruppting the liquid flow in each helical sub-pasageway so as to cause the flow to be spread and impinge on more of the inside wall area of the given coolant passage.

BRIEF DESCRIPTION OF THE DRAWING

The features of this invention believed to be novel and unobvious over the part art are set forth with particularity in the appended claims. The invention itself, however, as to the organization, method of operation and objects and advantages thereof, may best be understood by reference to the following description taken in conjunction with the accompanying drawing wherein:

MANNER AND PROCESS OF MAKING AND USING THE INVENTION

Figure 1:
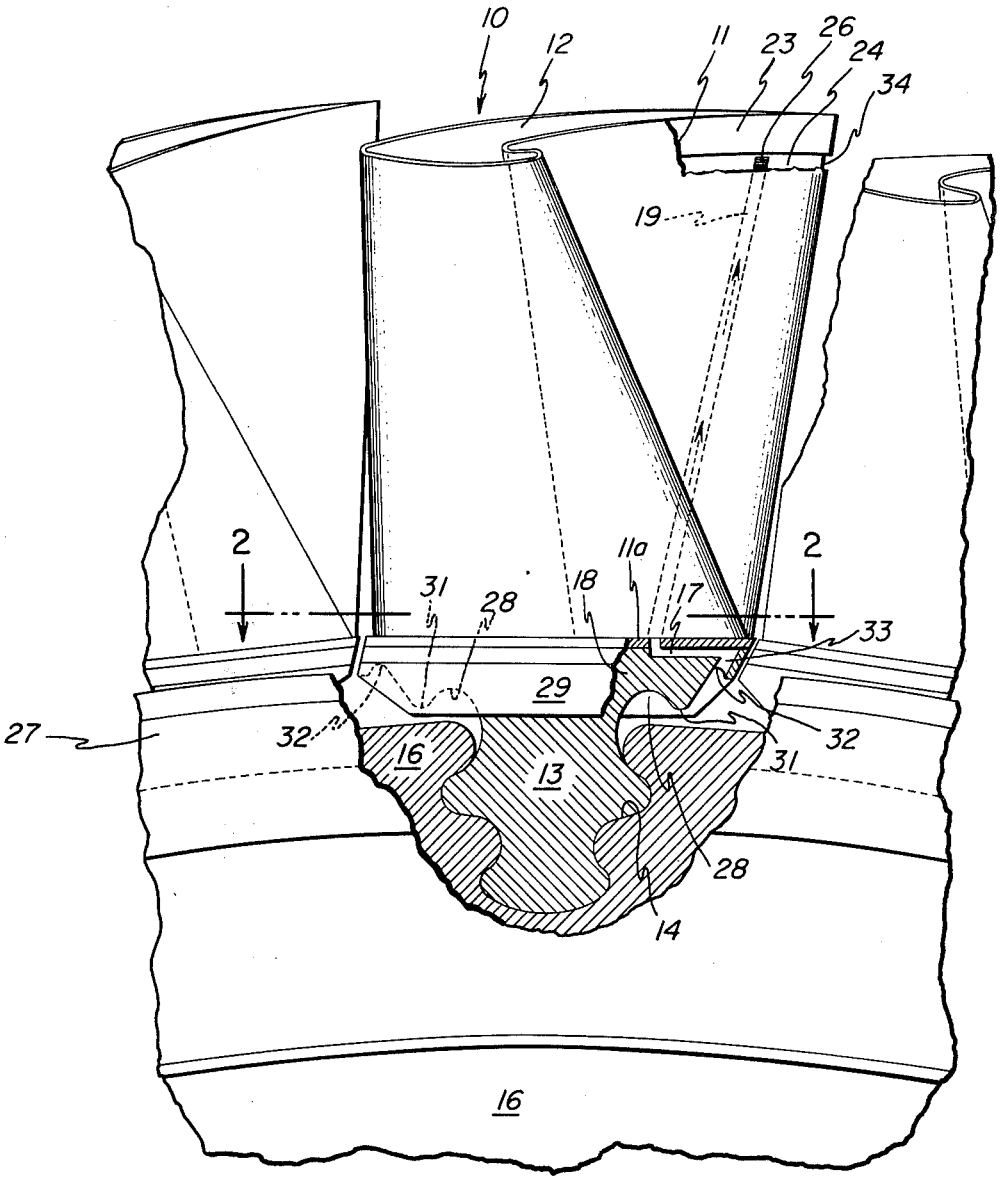
FIG. 1 is a view partially in section and partially cut away showing root, platform and airfoil-shaped portions of a liquid-cooled turbine bucket.
Figure 2:
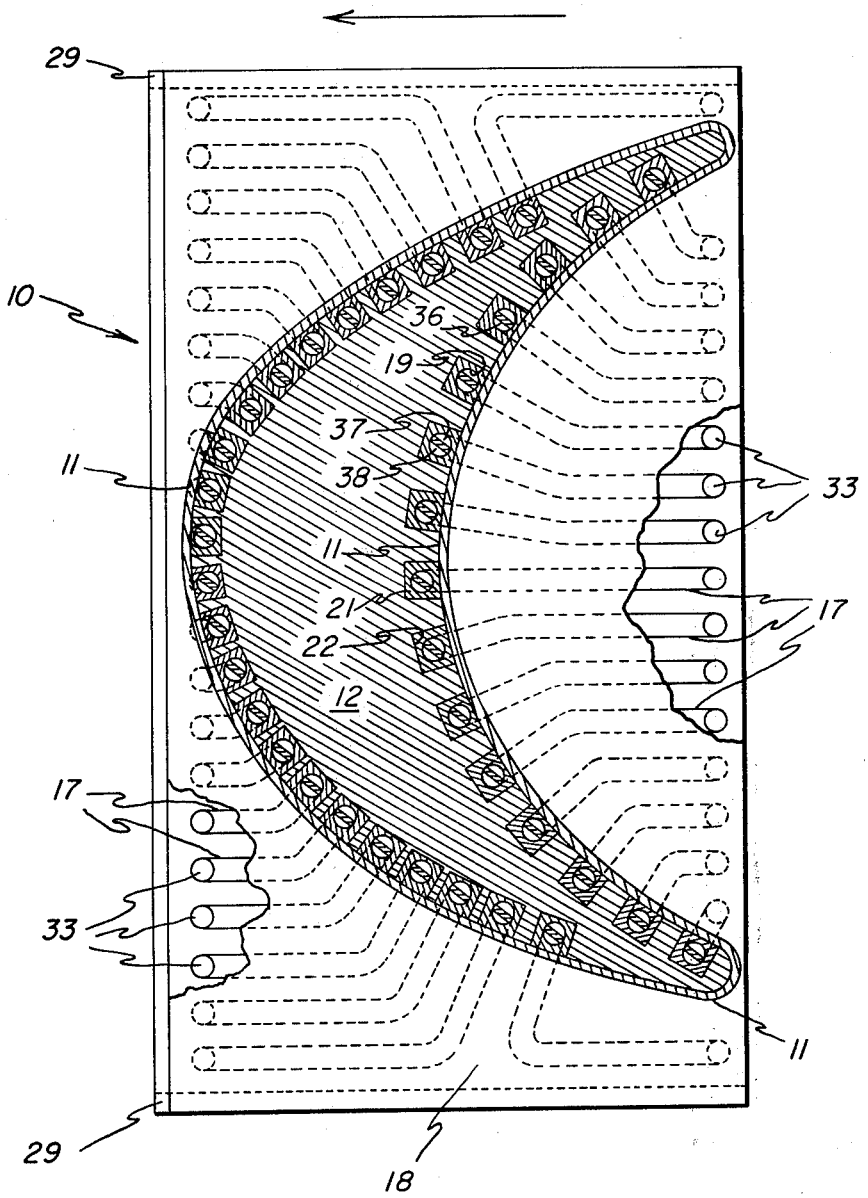
FIG. 2 is a view taken on line 2—2 of FIG. 1 with the platform skin removed in part.

The particular type of bucket construction shown in FIGS. 1 and 2 and described herein is merely exemplary and the invention is broadly applicable to open-circuit liquid-cooled turbine buckets equipped with sub-surface coolant passages of substantially circular transverse cross-section.

The turbine bucket 10 shown consists of skin 11, 11a, preferably of a heat- and wear-resistant material, affixed to a unitary bucket core 12 (i.e. root/platform/airfoil). Root portion 13, as shown, is formed in the conventional dovetail configuration by which bucket 10 is retained in slot 14 of wheel rim 16. Each groove 17 recessed in the surface of platform portion 18 is connected to and in flow communication with tube member 19 set in a metallic matrix 21 of high thermal conductivity in a recess, e.g., slot 22 extending generally spanwise in the surface of airfoil portion 23 of core 12. The airfoil portion 23 together with skin 11 comprises the airfoil portion of bucket 10. If desired, of course, sub-surface coolant passages 19 may be in the form of preformed tubes set into recessed grooves in skin 11. The general arrangement of coolant passages recessed in the airfoil skin is shown in U.S. Pat. No. 3,619,076 referred to hereinabove. As has been previously stated, the use of preformed tubes as coolant passages, per se, is the invention of another.

Liquid coolant is conducted through the coolant passages at a substantially uniform distance from the exterior surface of bucket 10. At the radially outer ends of the coolant passages 19 on the pressure side of bucket 10, these passages are in flow communication with, and terminate at, manifold 24 recessed into airfoil portion 23. On the suction side of bucket 10 the coolant passages, or channels, are in flow communication with, and terminate at, a similar manifold (not shown) recessed into airfoil portion 23. Near the trailing edge of bucket 10 a cross-over conduit (opening shown at 26) connects the manifold on the suction side with manifold 24. Open-circuit cooling is accomplished by spraying cooling liquid (usually water) at low pressure in a generally radially outward direction from nozzles (not shown) mounted on each side of the rotor disk. The coolant is received in an annular gutter, not shown in detail, formed in annular ring member 27, this ring member and the flow of coolant to and from the gutter is more completely described in the aforementioned Grondahl et al. patent, incorporated by reference.

Liquid coolant received in the gutters, is directed through feed holes (not shown) interconnecting the gutters with reservoirs 28, each of which extends in the direction parallel to the axis of rotation of the turbine disk.

The liquid coolant accumulates to fill each reservoir 28 (the ends thereof being closed by means of a pair of cover plates 29). As liquid coolant continues to reach each reservoir 28, the excess discharges over the crest of weir 31 along the length thereof and is thereby metered to the one side or the other of bucket 10.

Coolant that has traversed a given weir crest 31 continues in the generally radial direction to enter longitudinally-extending platform gutter 32 as a film-like distribution, passing thereafter through the coolant channel feed holes 33. Coolant passes from holes 33 to manifold 24 (and suction manifold, not shown) via platform and vane coolant passages.

As the coolant traverses the sub-surfaces of the platform portion and of the airfoil portion, these elements are kept cool with a quantity of the coolant being converted to the gaseous or vapor state as it absorbs heat, this quantity depending upon the relative amounts of coolant employed and heat encountered. The vapor or gas and any remaining liquid coolant exit from the manifold 24 via opening 34, preferably to enter a collection slot (not shown) formed in the casing for the eventual recirculation or disposal of the ejected liquid.

The amount of coolant admitted to the system for transit through the coolant passages may be varied and in those instances in which minimum coolant flow and high heat flux prevail, objectionable dry-out of the coolant passages may be encountered.

In the best mode contemplated (as illustrated in FIGS. 2. and 3) the interiors of all, or selected, coolant passages 19 in a liquid-cooled turbine bucket 10 are provided with a flow divider, or flow splitter, 36 (prepared by twisting a thin strip about its longitudinal axis) affixed to the inner surface of tube 19 along both edges of the strip. As liquid coolant passes from the platform coolant passages (defined by grooves 17 and skin 11*a*) into each coolant passage 19 under the influence of centrifugal force the liquid flow splits and subflows pass into helical volumes 37,38 to either side of twisted tape 36 presuming that the disposition of the lower end of the tape 36 is favorable relative to the trailing edge of tube 19, where the coolant flow is held by the Coriolis force.

There is no need to split the flow exactly into equal volume sub-flows, because as the sub-flows travel along helically directed intersections between flow splitter 36 and coolant passage 19 as narrow streams, these streams encounter and are interrupted by slots, or cuts, 39 in flow-splitter 36. At these locations the liquid streams are broken up and liquid can pass from one helical volume to the other, spill onto the inner wall of tube 19 and widen its area of contact therewith. Preferably the slots 39 are equally-spaced and extend about 1/2 of the way toward the center of tube 19 with those slots located in the same helical path being set apart a distance about equal to the tube diameter, but the optimum spacing, depth and width of the slots can be readily determined for a given bucket construction by routine experimentation. Overly narrow slots should not be used, or else in manufacture some of the slots may be closed off inadvertently by the braze material or other agent used to bond strip 36 to the inside surface of tube 19.

Preferably the twisting of tape 36 should be done so as to produce a pair of tight (i.e., reduced pitch) helical passageways. In all instances the helical axis extending in the same radial direction as the coolant passage in which it is affixed.

The invention has been illustrated by the use of a twisted tape whereby the inside volume of tube 19 is sub-divided into a pair of helical passageways. However, if the splitter element, before being twisted, were to be a body in a form in which three or more webs radiate from a central axis, the shape after twisting the body about the central axis could define a larger number of helical passageways within tube 19 as desired. In such a construction each web of the flow splitter should be provided with interrupting means, such as slots 39, and each web would be bonded along its outer edge to the inside of tube 19 or otherwise fixed in place, e.g., by mechanical joining.

Figure 3:
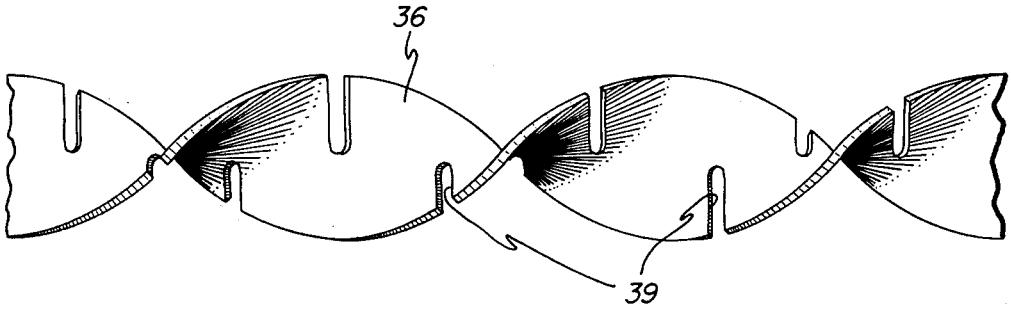
FIG. 3 is an elevational view of a portion of the notched, or slotted, twisted tape used in FIG. 2 to convert the inner volume of the coolant passage into a pair of helical sub-passageways according to this invention.

The tube and splitter construction shown in FIG. 3 may be prepared, for example, by taking an annealed 347 stainless steel tube 0.125" O.D. and 0.100" I.D. (as tube 19) and forming the splitter element from a nickel ribbon 0.100" wide and 0.010" thick. The nickel ribbon is twisted about its central axis so that the edges thereof generate helices having a pitch of about 0.4"–0.5" and the edges are then provided with saw cuts about 0.2" apart along each edge. Each saw cut is about 0.05" deep and about 0.01" wide. The twisted splitter element is plated with about ½ mil of copper and then inserted into the stainless steel tube. This assembly is next pulled through a 0.121" drawing die to provide metal-to-metal contact (i.e., a tight mechanical bond) between the notched splitter element and the tube wall. The assembly so formed is fired in a dry hydrogen furnace to provide a cupro-nickel metallurgical bond providing excellent heat transfer across the splitter element/tube juncture. The use of the aforementioned materials, shapes and sizes are merely illustrative and many variations thereof can readily be prepared by the technician utilizing the teachings set forth herein.

By providing a plurality of helical passageways within any given coolant passage, the Coriolis force, which tends to push the fluid to one side of the coolant passage, is overwhelmed by the centripetal effects in the helical passage which prevents favoring of a given side of the coolant passage. The flow-interrupting means by breaking up each narrow stream of coolant passing along its helical path enhances the effectiveness of the liquid cooling mechanism. Each sub-flow of coolant is pulled along its helical path by the centrifugal body force and the amount of work which this force does on the fluid is the same whether the coolant passageway traversed were to be straight or helical. In the case of the helical passageways with the flow interrupters, this work creates more vorticity, a larger wetted area, better cooling and reduced erosion of the coolant passage wall.

We claim:

1. In liquid-cooled turbine bucket construction comprising an airfoil-shaped portion, a platform portion and a root portion for mounting said bucket in the rim of a rotatable turbine wheel, wherein at least said airfoil-shaped portion has a plurality of open-circuit distribution paths including subsurface coolant passages extending generally spanwise along the pressure and suction faces of said airfoil-shaped portion and liquid coolant metering means in flow communication therewith, the improvement comprising:

said coolant passages being of substantially circular transverse cross-section;

means for splitting liquid coolant flow affixed within individual coolant passages, said splitting means subdividing the internal volume of each such coolant passage into a plurality of helical passageways; and means provided along said splitting means for interrupting liquid flow coming into contact with said liquid flow interrupting means and increasing the area of contact of the liquid flow with the coolant passage inner surface area adjacent thereto.

2. The improved liquid-cooled turbine bucket as recited in claim 1 wherein each splitting means is a twisted tape disposed along a coolant passage.

3. The improved liquid-cooled turbine bucket as recited in claim 2 wherein the interrupting means are slots spaced along the edges of the twisted tape.

4. The improved liquid-cooled turbine bucket as recited in claim 3 wherein each slot extends from an edge of the twisted tape for a distance of about one-half of the width of said tape.

5. The improved liquid-cooled turbine bucket as recited in claim 2 wherein each twisted tape is metallurgically bonded along its edges to the interior surface of the coolant passage wherein it is located.

6. The improved liquid-cooled turbine bucket as recited in claim 2 wherein each twisted tape is mechanically bonded along its edges with the interior surface of the coolant passage wherein it is located.

* * * * *